US009542899B2

(12) United States Patent
Jeong et al.

(10) Patent No.: US 9,542,899 B2
(45) Date of Patent: Jan. 10, 2017

(54) METHOD OF DRIVING DISPLAY PANEL, DISPLAY PANEL DRIVING APPARATUS FOR PERFORMING THE METHOD AND DISPLAY APPARATUS HAVING THE DISPLAY PANEL DRIVING APPARATUS

(71) Applicant: SAMSUNG DISPLAY CO., LTD., Yongin, Gyeonggi-Do (KR)

(72) Inventors: Hyun-Woo Jeong, Suwon-Si (KR); Won-Jong Ohn, Jeonju-Si (KR); Joon-Bum Lee, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 16 days.

(21) Appl. No.: 14/644,833

(22) Filed: Mar. 11, 2015

(65) Prior Publication Data

US 2016/0111052 A1 Apr. 21, 2016

(30) Foreign Application Priority Data

Oct. 20, 2014 (KR) ..... 10-2014-0141891

(51) Int. Cl.
*G09G 3/36* (2006.01)

(52) U.S. Cl.
CPC ..... *G09G 3/3614* (2013.01); *G09G 3/3685* (2013.01); *G09G 2300/0426* (2013.01); *G09G 2300/0452* (2013.01); *G09G 2320/0247* (2013.01)

(58) Field of Classification Search
CPC ..... G09G 3/3614; G09G 3/3685; G09G 2320/0247;G09G 2300/0426; G09G 2300/0452
See application file for complete search history.

(56) References Cited

U.S. PATENT DOCUMENTS

| | | | | |
|---|---|---|---|---|
| 9,030,451 | B2 * | 5/2015 | Lee | G09G 3/3696 345/204 |
| 9,070,331 | B2 * | 6/2015 | Jang | G09G 3/3614 |
| 2009/0015744 | A1 * | 1/2009 | Sekine | G09G 3/3659 349/39 |
| 2011/0249046 | A1 * | 10/2011 | Lee | G09G 3/3688 345/691 |
| 2013/0223515 | A1 | 8/2013 | Shetty et al. | |

FOREIGN PATENT DOCUMENTS

| | | |
|---|---|---|
| JP | 2013-020188 | 1/2013 |
| KR | 10-2013-0028596 | 3/2013 |
| KR | 10-2014-0062297 | 5/2014 |

* cited by examiner

*Primary Examiner* — Abbas Abdulselam
(74) *Attorney, Agent, or Firm* — F. Chau & Associates, LLC

(57) ABSTRACT

A method of driving a display panel includes applying gate signals to gate lines of the display panel that extend in a first direction. A plurality of data lines extends in a second direction perpendicular to the first direction. Pixels are defined by an intersection of the gate lines and the data lines. Common electrode contact pixels are provided, in which a common electrode is contacted with a gate electrode extruded from the gate line. A data signal having a first polarity and a data signal having a second polarity, inverse to the first polarity, are applied to an equal number of the common electrode contact pixels.

18 Claims, 6 Drawing Sheets

METHOD OF DRIVING DISPLAY PANEL, DISPLAY PANEL DRIVING APPARATUS FOR PERFORMING THE METHOD AND DISPLAY APPARATUS HAVING THE DISPLAY PANEL DRIVING APPARATUS

CROSS-REFERENCE TO RELATED APPLICATION(S)

This application claims priority under 35 U.S.C. §119 to Korean Patent Application No. 10-2014-0141891, filed on Oct. 20, 2014 in the Korean Intellectual Property Office (KIPO), the contents of which are herein incorporated by reference in their entireties.

TECHNICAL FIELD

Exemplary embodiments of the present inventive concept relate to driving a display panel, and more particularly, exemplary embodiments of the present inventive concept relate to a method of driving a display panel, a display panel driving apparatus, and a display apparatus having the display panel driving apparatus.

DISCUSSION OF THE RELATED ART

A liquid crystal display apparatus may include a liquid crystal display panel and a display panel driving apparatus for driving the display panel.

The liquid crystal display panel may include a lower substrate, in which a pixel electrode and a switching element such as a thin film transistor are formed, an upper substrate in which a common electrode is formed, and a liquid crystal layer interposed between the lower substrate and the upper substrate. An arrangement of a liquid crystal included in the liquid crystal layer may be changed by the application of an electric field formed by a pixel voltage applied to the pixel electrode and a common voltage applied to the common electrode.

In addition, the display panel includes a plurality of gate lines extending in a first direction, a plurality of data lines extending in a second direction, perpendicular to the first direction, and a plurality of pixels defined by the intersection of the gate lines and the data lines.

The common electrode includes a transparent electrode having a relatively high resistivity. The common electrode may be connected to a gate electrode of the switching element, which has less resistivity than the common electrode. In this case, when data voltages used to charge the pixels, in which the common electrode is contacted with the gate electrode, have one polarity, a flicker of an image displayed on the liquid crystal display panel may be generated. Thus, display quality of the liquid crystal display apparatus may be degraded.

SUMMARY

Exemplary embodiments of the present inventive concept provide a method of driving a display panel capable of increasing display quality.

Exemplary embodiments of the present inventive concept also provide a display panel driving apparatus for performing the above-mentioned method for driving the display panel.

Exemplary embodiments of the present inventive concept also provide a display apparatus having the above-mentioned display panel driving apparatus.

According to an exemplary embodiment of the present inventive concept, a method of driving a display panel includes applying gate signals to a plurality of gate lines of the display panel that extend in a first direction. A plurality of data lines extends in a second direction perpendicular to the first direction. Pixels are defined by an intersection of the gate lines and the data lines. Common electrode contact pixels are provided, in which a common electrode is contacted with a gate electrode extruded from the gate line. A data signal having a first polarity and a data signal having a second polarity are applied to an equal number of the common electrode contact pixels. The second polarity is the inverse of the first polarity.

In one exemplary embodiment, the applying of the data signals may include repeatedly applying data signals to the pixels disposed in the second direction in the following order: data signals having the first polarity, data signals having the second polarity, data signals having the first polarity, data signals having the first polarity, data signals having the second polarity, data signals having the first polarity, data signals having the second polarity, and data signals having the second polarity.

In one embodiment, the applying of the data signals may include repeatedly applying data signals to the pixels disposed in the first direction in the following order: data signals having the first polarity, data signals having the second polarity, data signals having the second polarity, data signals having the first polarity, data signals having the first polarity, data signals having the second polarity, data signals having the second polarity, data signals having the first polarity, data signals having the second polarity, data signals having the first polarity, data signals having the first polarity, data signals having the second polarity, data signals having the second polarity, data signals having the first polarity, data signals having the first polarity, and data signals having the second polarity.

In one embodiment, the applying of the data signals may include repeatedly applying data signals to the pixels disposed in the second direction in the following order: data signals having the first polarity, data signals having the second polarity, data signals having the first polarity, data signals having the second polarity, data signals having the second polarity, data signals having the first polarity, data signals having the second polarity, and data signals having the first polarity.

In one embodiment, the applying of the data signals may include repeatedly applying data signals to the pixels disposed in the first direction in the following order: data signals having the first polarity, data signals having the second polarity, data signals having the second polarity, data signals having the first polarity, data signals having the first polarity, data signals having the second polarity, data signals having the second polarity, data signals having the first polarity, data signals having the second polarity, data signals having the first polarity, data signals having the first polarity, data signals having the second polarity, data signals having the second polarity, data signals having the first polarity, data signals having the first polarity, and data signals having the second polarity.

In one embodiment, the applying of the data signals may include equally applying the data signal having the first polarity and the data signal having the second polarity to the pixels.

In one embodiment, the pixels may include a red pixel, a green pixel, a blue pixel and a white pixel.

In one embodiment, the blue pixel may correspond to the common electrode contact pixel.

In one embodiment, the display panel may sequentially and repeatedly include the red pixel, the green pixel, the blue pixel and the white pixel in the first direction in an odd-numbered pixel row.

In one embodiment, the display panel may sequentially and repeatedly include the blue pixel, the white pixel, the red pixel and the green pixel in the first direction in an even-numbered pixel row.

In one embodiment, the blue pixels may alternately include the common electrode contact pixel in the first direction.

In one embodiment, the blue pixels may alternately include the common electrode contact pixel in the second direction.

According to an exemplary embodiment of the present inventive concept, a display panel driving apparatus includes a gate driving part and a data driving part. The gate driving part is configured to apply gate signals to gate lines of a display panel including a plurality of gate lines extending in a first direction. A plurality of data lines extends in a second direction perpendicular to the first direction. Pixels are defined by the gate lines and the data lines and having common electrode contact pixels in which a common electrode is contacted with a gate electrode extruded from the gate line. The data driving part is configured to equally apply a data signal having a first polarity and a data signal having a second polarity to the common electrode contact pixels, the second polarity being inverted to the first polarity.

In one embodiment, the data driving part may repeatedly apply data signals to the pixels disposed in the second direction in the following order: data signals having the first polarity, data signals having the second polarity, data signals having the first polarity, data signals having the first polarity, data signals having the second polarity, data signals having the first polarity, data signals having the second polarity, and data signals having the second polarity. The data driving part may repeatedly apply data signals to the pixels disposed in the first direction in the following order: data signals having the first polarity, data signals having the second polarity, data signals having the second polarity, data signals having the first polarity, data signals having the first polarity, data signals having the second polarity, data signals having the second polarity, data signals having the first polarity, data signals having the second polarity, data signals having the first polarity, data signals having the first polarity, data signals having the second polarity, data signals having the second polarity, data signals having the first polarity, data signals having the first polarity, and data signals having the second polarity.

In one embodiment, the data driving part may repeatedly apply data signals to the pixels disposed in the second direction in the following order: data signals having the first polarity, data signals having the second polarity, data signals having the first polarity, data signals having the second polarity, data signals having the second polarity, data signals having the first polarity, data signals having the second polarity, and data signals having the first polarity. The data driving part may repeatedly apply data signals to the pixels disposed in the first direction in the following order: data signals having the first polarity, data signals having the second polarity, data signals having the second polarity, data signals having the first polarity, data signals having the first polarity, data signals having the second polarity, data signals having the second polarity, data signals having the first polarity, data signals having the second polarity, data signals having the first polarity, data signals having the first polarity, data signals having the second polarity, data signals having the second polarity, data signals having the first polarity, data signals having the first polarity, and data signals having the second polarity.

In one embodiment, the pixels may include a red pixel, a green pixel, a blue pixel and a white pixel, and the blue pixel may correspond to the common electrode contact pixel.

According to an exemplary embodiment of the present inventive concept, a display apparatus includes a display panel and a display panel driving apparatus. The display panel includes a plurality of gate lines extending in a first direction, a plurality of data lines extending in a second direction perpendicular to the first direction, and pixels defined by an intersection of the gate lines and the data lines. The display panel includes common electrode contact pixels in which a common electrode is contacted with a gate electrode extruded from the gate line. A display panel driving apparatus includes a gate driving part configured to apply gate signals to the gate lines, and a data driving part configured to equally apply a data signal having a first polarity and a data signal having a second polarity to the common electrode contact pixels. The second polarity is an inversion of the first polarity.

In one embodiment, the pixels may include a red pixel, a green pixel, a blue pixel and a white pixel, and the blue pixel may correspond to the common electrode contact pixel.

In one embodiment, the display panel may sequentially and repeatedly include the red pixel, the green pixel, the blue pixel and the white pixel in the first direction in an odd-numbered pixel row, and may sequentially and repeatedly include the blue pixel, the white pixel, the red pixel and the green pixel in the first direction in an even-numbered pixel row.

In one embodiment, the blue pixels may alternately include the common electrode contact pixel in the first direction and the second direction.

According to an exemplary embodiment of the present inventive concept, a flicker of an image displayed on a display panel may be decreased, and thus display quality of a display apparatus may be increased.

BRIEF DESCRIPTION OF THE DRAWINGS

The above and other features and aspects of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
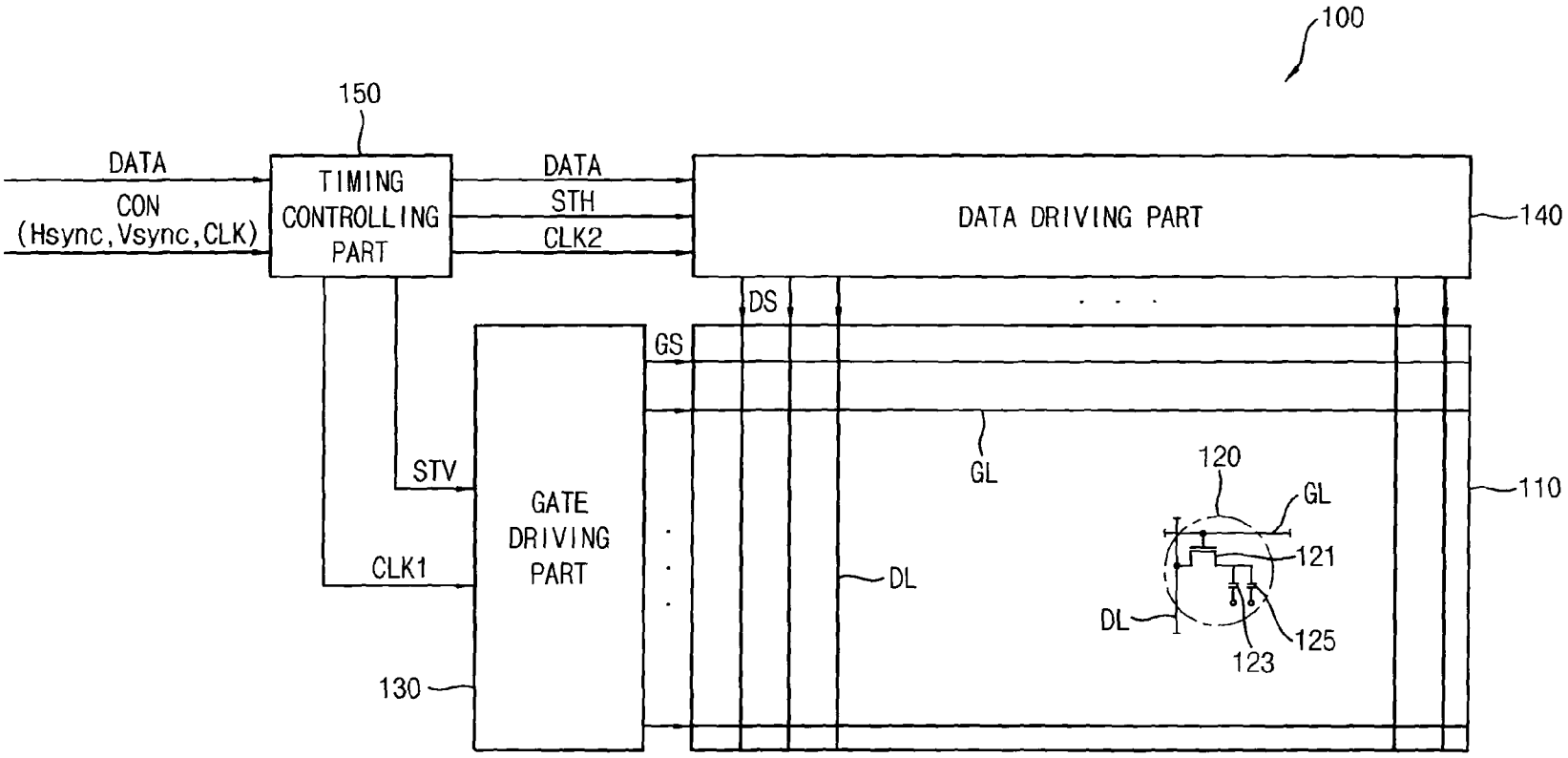
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 130, a data driving part 140 and a timing controlling part 150. The gate driving part 130, the data driving part 140 and the timing controlling part 150 may be defined as a display panel driving apparatus driving the display panel 110.

The display panel 110 receives a data signal DS based on an image data DATA provided from the timing controlling part 150 to display an image. For example, the image data DATA may be two-dimensional plane image data. Alternatively, the image data DATA may include a left-eye image data and a right-eye image data for displaying a three-dimensional stereoscopic image.

The display panel 110 includes gate lines GL, data lines DL and a plurality of pixels 120. The gate line GL extends in a first direction D1 and the data line DL extends in a second direction D2 substantially perpendicular to the first direction D1. Each of the pixels 120 includes a thin film transistor 121 electrically connected to the gate line GL and the data line DL, a liquid crystal capacitor 123 and a storage capacitor 125 connected to the thin film transistor 121. Thus, the display panel 110 may be a liquid crystal display panel including a liquid crystal, and the display apparatus 100 may be a liquid crystal display apparatus.

The gate driving part 130 generates a gate signal GS in response to a gate start signal STV and a gate clock signal CLK1 provided from the timing controlling part 150, and outputs the gate signal GS to the gate line GL.

The data driving part 140 outputs a data signal DS to the data line DL in response to a data start signal STH and a data clock signal CLK2 provided from the timing controlling part 150.

The timing controlling part 150 receives the image data DATA and a control signal CON from an outside source. The control signal CON may include a horizontal synchronous signal Hsync, a vertical synchronous signal Vsync and a clock signal CLK. The timing controlling part 150 generates the data start signal STH using the horizontal synchronous signal Hsync and outputs the data start signal STH to the data driving part 140. The timing controlling part 150 generates the gate start signal STV using the vertical synchronous signal Vsync and outputs the gate start signal STV to the gate driving part 130. The timing controlling part 150 generates the gate clock signal CLK1 and the data clock signal CLK2 using the clock signal CLK, outputs the gate clock signal CLK1 to the gate driving part 130, and outputs the data clock signal CLK2 to the data driving part 140.

Figure 2:
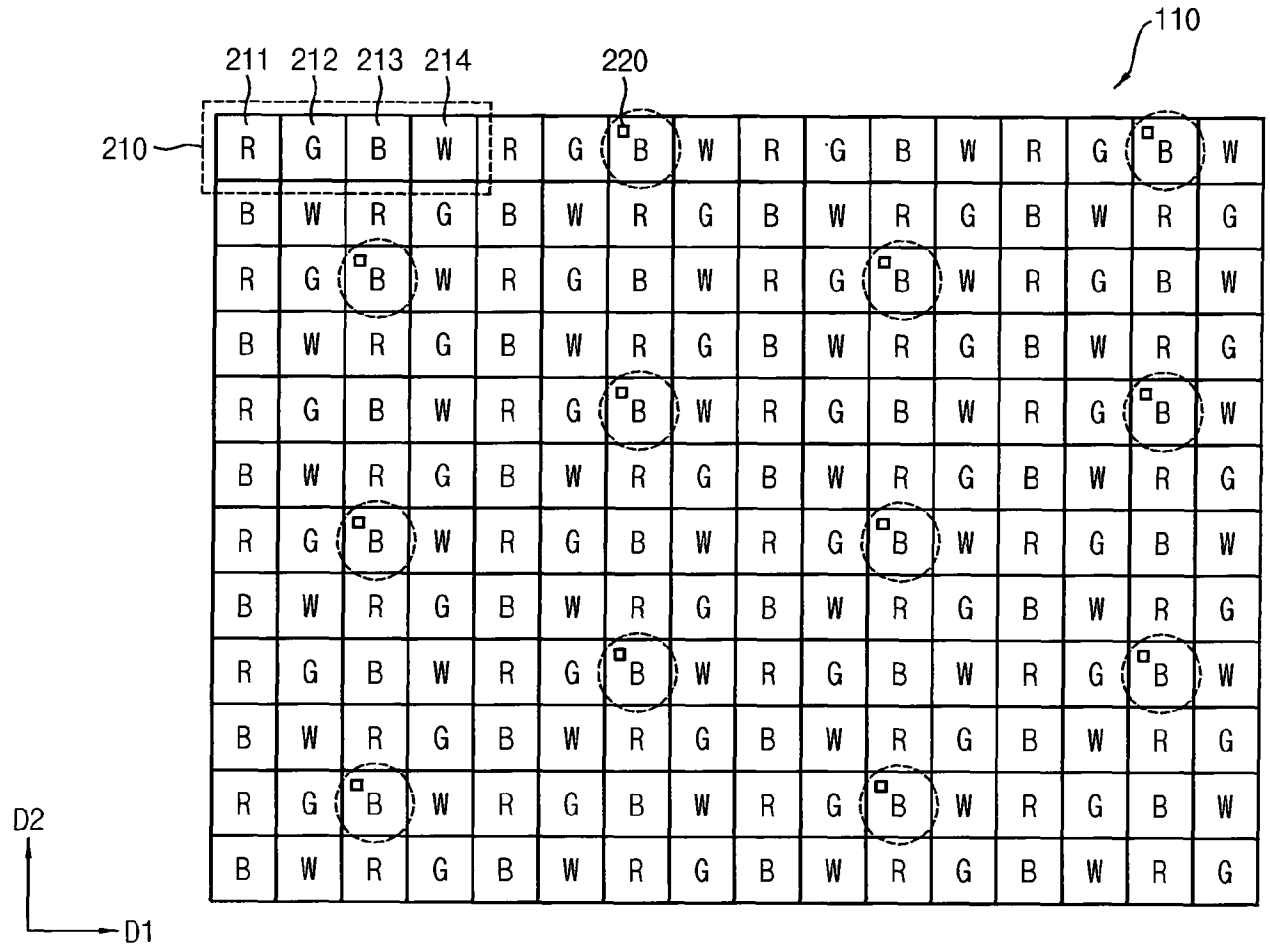
FIG. 2 is a plan view illustrating a portion of a display panel in FIG. 1.

FIG. 2 is a plan view illustrating a portion of the display panel 110 in FIG. 1.

Referring to FIGS. 1 and 2, the display panel 110 includes a unit pixel 210. The unit pixel 210 includes a first pixel 211, a second pixel 212, a third pixel 213 and a fourth pixel 214. For example, the first pixel 211 may be a red pixel, the second pixel 212 may be a green pixel, the third pixel 213 may be a blue pixel, and the fourth pixel 214 may be a white pixel.

Each of the first pixel 211, the second pixel 212, the third pixel 213 and the fourth pixel 214 may correspond to the pixel 120 of FIG. 1. Thus, each of the first pixel 211, the second pixel 212, the third pixel 213 and the fourth pixel 214 may include the thin film transistor 121 electrically connected to the gate line GL and the data line DL, the liquid crystal capacitor 123 and the storage capacitor 125 connected to the thin film transistor 121. Here, the thin film transistor 121 may include a gate electrode protruded from the gate line GL, a source electrode connected to the data line DL, and a drain electrode electrically connected to a pixel electrode.

The display panel 110 sequentially and repeatedly includes the first pixel 211, the second pixel 212, the third pixel 213 and the fourth pixel 214 in the first direction D1 in an odd-numbered pixel row. In addition, the display panel 110 sequentially and repeatedly includes the third pixel 213, the fourth pixel 214, the first pixel 211 and the second pixel 212 in the first direction D1 in an even-numbered pixel row.

A common electrode may be connected to the gate electrode of a switching element such as the thin film transistor 121 formed in a pixel in order to prevent a ripple in a common voltage, in a portion of the first pixels 211, the second pixels 212, the third pixels 213 and the fourth pixels 214. For example, the common electrode may be contacted with the gate electrode in a portion of the third pixels 213 which are the blue pixels having a luminance less than a luminance of the red pixel and a luminance of the green pixel. Each of the blue pixels in which the common electrode is contacted with the gate electrode may be defined as a common electrode contact pixel. For example, the common electrode may be contacted with the gate electrode through a contact hole in each of the common electrode contact pixels. Thus, each of the common electrode contact pixels includes a contact point 220 in which the common electrode is contacted with the gate electrode. The blue pixels alternately include the common electrode contact pixels in the first direction D1. In addition, the blue pixels alternately include the common electrode contact pixels in the second direction D2. Thus, the blue pixels alternately include the blue pixel which is the common electrode contact pixel and the blue pixel which is not the common electrode contact pixel in the first direction D1 and the second direction D2.

Figure 3:
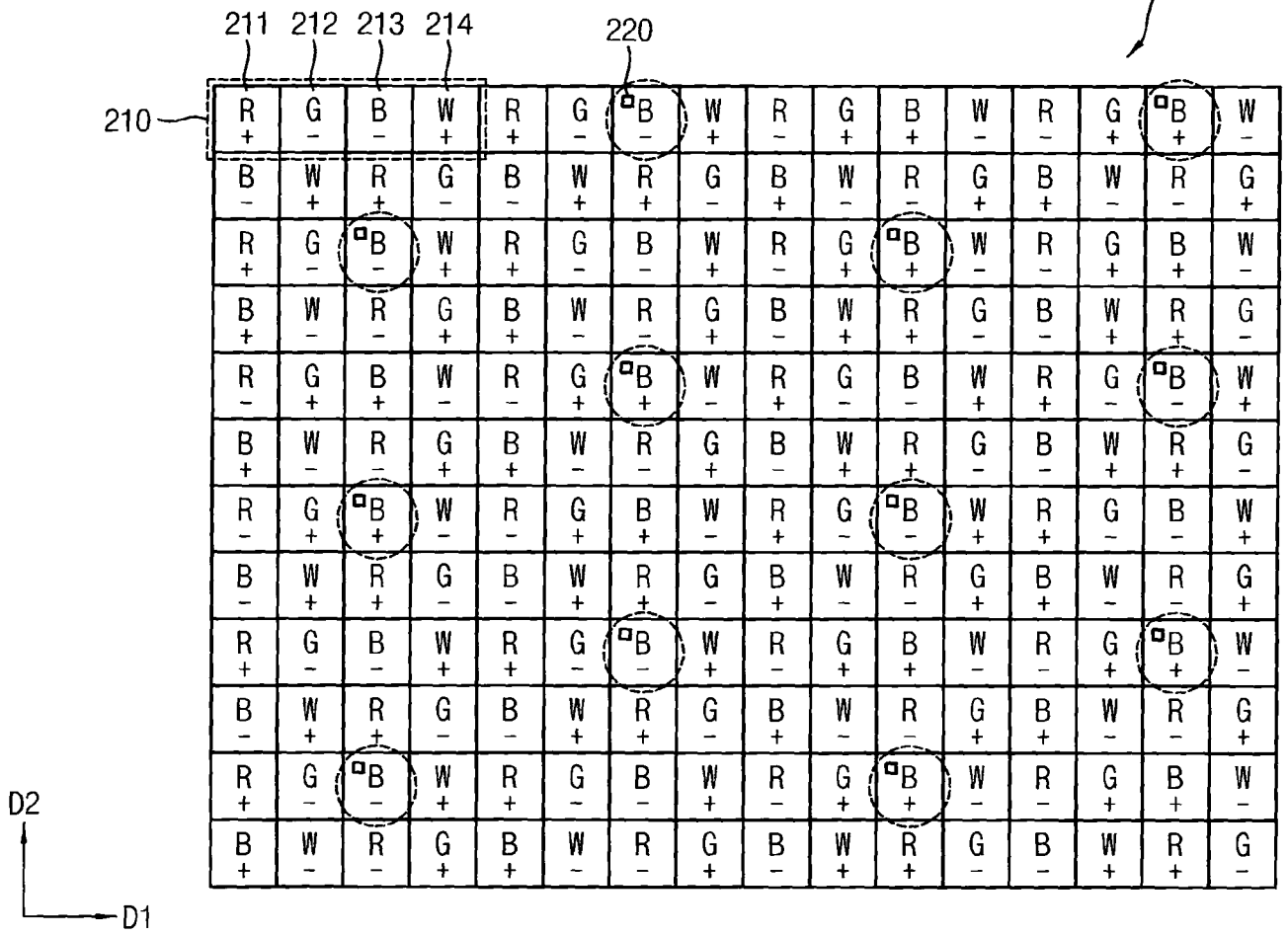
FIG. 3 is a conceptual diagram illustrating polarities of data voltages charged in pixels of the display panel in FIG. 1.

FIG. 3 is a conceptual diagram illustrating polarities of data voltages charged in the pixels 120 of the display panel 110 in FIG. 1.

Referring to FIGS. 1 to 3, the data driving part 140 equally applies a data signal having a first polarity and a data signal having a second polarity, which is an inverse of the first polarity, to the common electrode contact pixels having the contact point 220 where the common electrode is contacted with the gate electrode. In addition, the data driving part 140 equally applies the data signal having the first polarity and the data signal having the second polarity to the pixels 120 including the first pixel 211, the second pixel 212, the third pixel 213 and the fourth pixel 214.

For example, the data driving part 140 repeatedly applies data signals having the first polarity, the second polarity, the first polarity, the first polarity, the second polarity, the first polarity, the second polarity and the second polarity to the pixels disposed in the second direction D2, in this stated order. In addition, the data driving part 140 repeatedly applies data signals having the first polarity, the second polarity, the second polarity, the first polarity, the first polarity, the second polarity, the second polarity, the first polarity, the second polarity, the first polarity, the first polarity, the second polarity, the second polarity, the first polarity, the first polarity and the second polarity to the pixels disposed in the first direction D1, in this stated order.

Thus, data voltages having the first polarity, the second polarity, the first polarity, the first polarity, the second polarity, the first polarity, the second polarity and the second polarity are repeatedly charged in the pixels disposed in the second direction D2, in this stated order, and data voltages having the first polarity, the second polarity, the second polarity, the first polarity, the first polarity, the second polarity, the second polarity, the first polarity, the second polarity, the first polarity, the first polarity, the second polarity, the second polarity, the first polarity, the first polarity and the second polarity are repeatedly charged in the pixels disposed in the first direction D1, in this stated order.

Thus, the number of the common electrode contact pixels in which the data voltage having the first polarity is charged and the number of the common electrode contact pixels in which the data voltage having the second polarity is charged are the same. In addition, the number of the pixels in which the data voltage having the first polarity is charged and the number of the pixels in which the data voltage having the second polarity is charged are the same.

The first polarity may be a positive polarity, and the second polarity may be a negative polarity. Alternatively, the first polarity may be the negative polarity, and the second polarity may be the positive polarity. Here, the positive polarity and the negative polarity may be determined with respect to a reference voltage. Thus, the data voltage having the positive polarity may be greater than the reference voltage, and the data voltage having the negative polarity may be less than the reference voltage. For example, the reference voltage may be a common voltage.

Figure 4A:
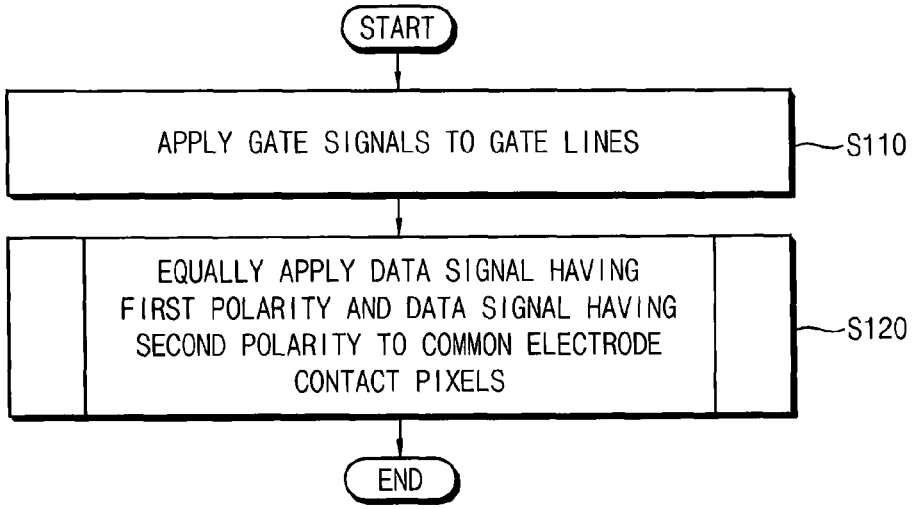
FIGS. 4A and 4B are flow charts illustrating a method of driving a display panel performed by a display panel driving apparatus of FIG. 1.
Figure 4B:
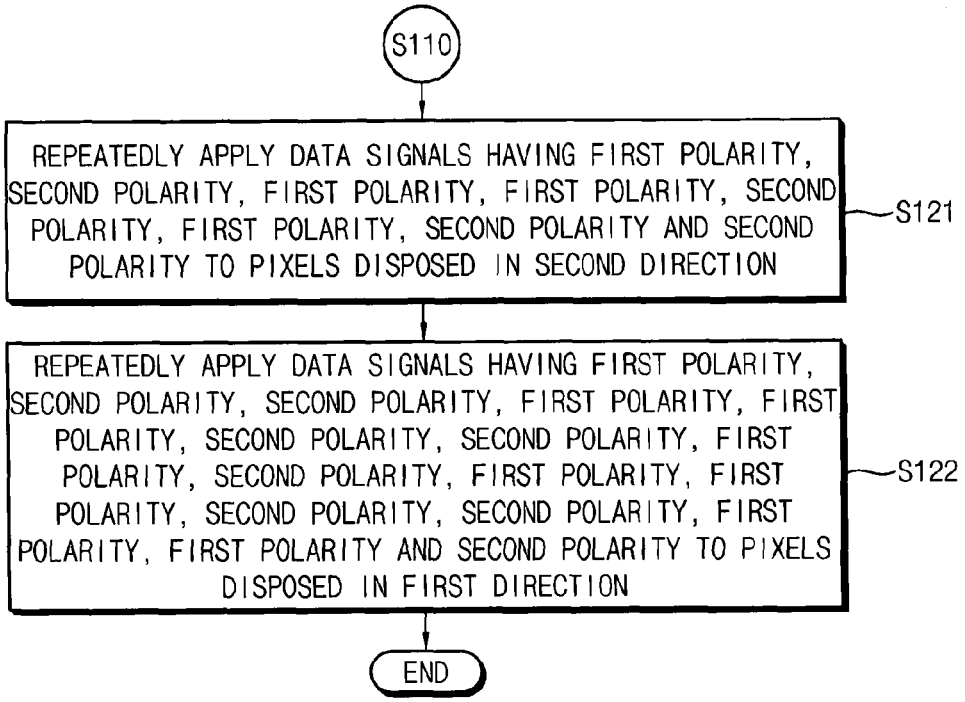

FIGS. 4A and 4B are flow charts illustrating a method of driving a display panel performed by the display panel driving apparatus of FIG. 1.

Referring to FIGS. 1 to 4B, the gate signals GS are applied to the gate lines DL (step S110). For example, the gate driving part 130 generates the gate signal GS in response to the gate start signal STV and the gate clock signal CLK1 provided from the timing controlling part 150, and outputs the gate signal GS to the gate line GL.

The data signal having the first polarity and the data signal having the second polarity are equally applied to the common electrode contact pixels (step S120). For example, the data driving part 140 repeatedly applies the data signals having the first polarity, the second polarity, the first polarity, the first polarity, the second polarity, the first polarity, the second polarity and the second polarity to the pixels disposed in the second direction D2, in this stated order (step S121). In addition, the data driving part 140 repeatedly applies data signals having the first polarity, the second polarity, the second polarity, the first polarity, the first polarity, the second polarity, the second polarity, the first polarity, the second polarity, the first polarity, the first polarity, the second polarity, the second polarity, the first polarity, the first polarity and the second polarity to the pixels disposed in the first direction D1, in this stated order (step S122).

Thus, the data voltages having the first polarity, the second polarity, the first polarity, the first polarity, the second polarity, the first polarity, the second polarity and the second polarity are repeatedly charged in the pixels disposed in the second direction D2, in this stated order, and the data voltages having the first polarity, the second polarity, the second polarity, the first polarity, the first polarity, the second polarity, the second polarity, the first polarity, the second polarity, the first polarity, the first polarity, the second polarity, the first polarity, the first polarity and the second polarity are repeatedly charged in the pixels disposed in the first direction D1, in this stated order.

In the method of driving the display panel shown in FIG. 4A, the step S110 and the step S120 are sequentially performed, but the method is not necessarily limited to this particular sequence. For example, the step S110 and the step S120 may be simultaneously performed. In addition, in the method of driving the display panel shown in FIG. 4B, the step S121 and the step S122 are sequentially performed, but the method is not necessarily limited to this particular sequence. For example, the step S121 and the step S122 may be simultaneously performed.

According to an exemplary embodiment of the present inventive concept, the data voltage having the first polarity and the data voltage having the second polarity are equally charged in the common electrode contact pixels. Therefore, a flicker of an image displayed on the display panel 110 may be decreased, and thus display quality of the display apparatus 100 may be increased.

Figure 5:
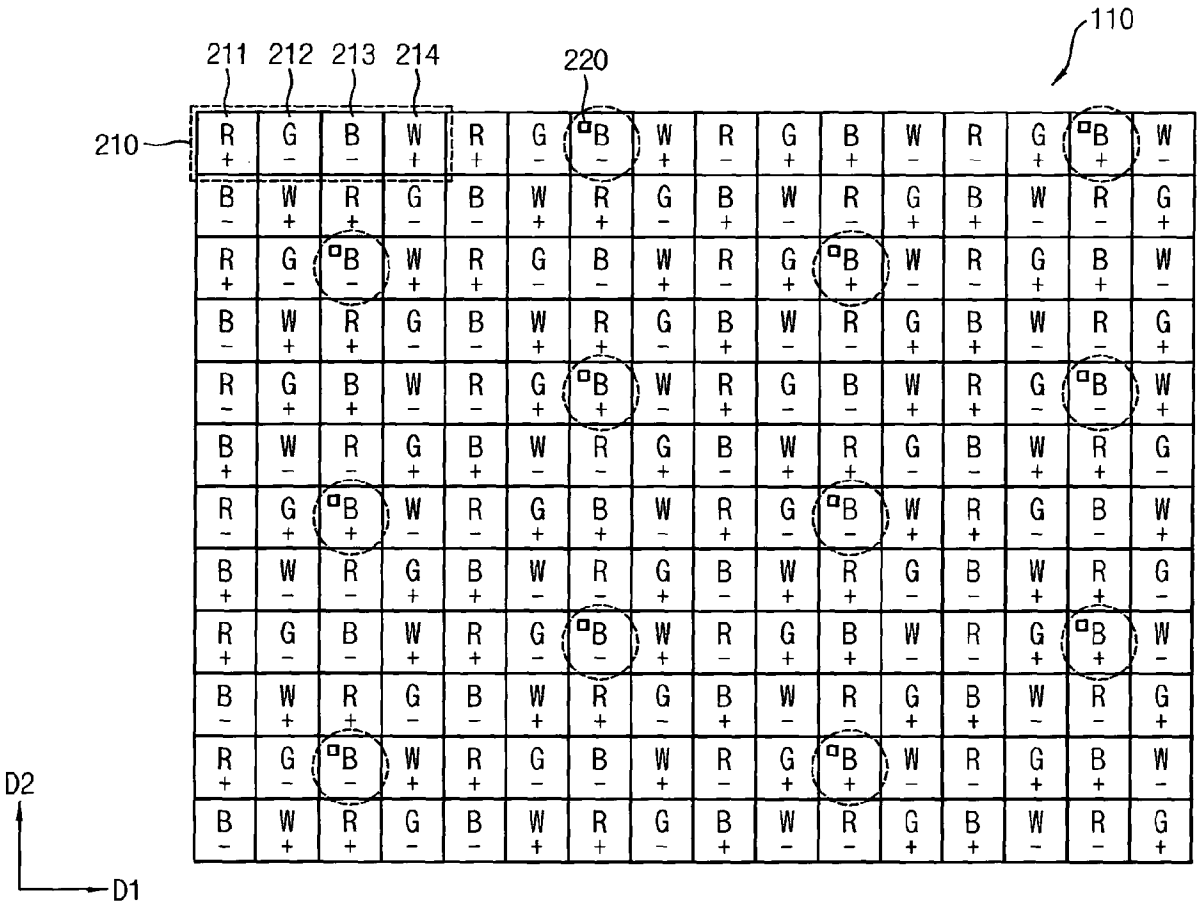
FIG. 5 is a conceptual diagram illustrating polarities of data voltages charged in pixels of a display panel according to an exemplary embodiment of the present inventive concept.

FIG. 5 is a conceptual diagram illustrating polarities of data voltages charged in pixels of a display panel according to an exemplary embodiment of the present inventive concept.

The display panel 110 according to the present exemplary embodiment may be substantially the same as the display panel 110 of FIGS. 1 to 3 as described above. Thus, the same reference numerals may be used to refer to same or like parts as those described previously and any further repetitive explanation concerning the above elements may be omitted.

Referring to FIGS. 1 and 5, the display panel 110 includes the unit pixel 210. The unit pixel 210 includes the first pixel 211, the second pixel 212, the third pixel 213 and the fourth pixel 214. For example, the first pixel 211 may be the red pixel, the second pixel 212 may be the green pixel, the third pixel 213 may be the blue pixel, and the fourth pixel 214 may be the white pixel.

Each of the first pixel 211, the second pixel 212, the third pixel 213 and the fourth pixel 214 may correspond to the pixel 120 of FIG. 1. Thus, each of the first pixel 211, the second pixel 212, the third pixel 213 and the fourth pixel 214 may include the thin film transistor 121 electrically connected to the gate line GL and the data line DL, the liquid crystal capacitor 123 and the storage capacitor 125 connected to the thin film transistor 121.

The display panel 110 sequentially and repeatedly includes the first pixel 211, the second pixel 212, the third pixel 213 and the fourth pixel 214 in the first direction D1 in the odd-numbered pixel row. In addition, the display panel 110 sequentially and repeatedly includes the third pixel 213, the fourth pixel 214, the first pixel 211 and the second pixel 212 in the first direction D1 in the even-numbered pixel row.

The common electrode may be connected to the gate electrode of the switching element such as the thin film transistor 121 formed in the pixel in order to prevent a ripple in the common voltage, in the portion of the first pixels 211, the second pixels 212, the third pixels 213 and the fourth pixels 214. For example, the common electrode may be connected to the gate electrode in the portion of the third pixels 213 which are the blue pixels having the luminance less than the luminance of the red pixel and the luminance of the green pixel. Each of the blue pixels, in which the common electrode is contacted with the gate electrode, may be defined as the common electrode contact pixel. For example, the common electrode may be contacted with the gate electrode through the contact hole in each of the common electrode contact pixels. Thus, each of the common electrode contact pixels includes the contact point 220 in which the common electrode is contacted with the gate electrode. The blue pixels alternately include the common electrode contact pixels in the first direction D1. In addition, the blue pixels alternately include the common electrode contact pixels in the second direction D2. Thus, the blue pixels alternately include the blue pixel, which is the common electrode contact pixel, and the blue pixel, which is not the common electrode contact pixel, in the first direction D1 and the second direction D2.

The display panel 110 may be driven by the display panel driving apparatus including the gate driving part 130, the data driving part 140 and the timing controller 150 of FIG. 1 according to the previous described approach.

Referring to FIGS. 1 and 5, the data driving part 140 equally applies the data signal having the first polarity and the data signal having the second polarity, which is an inversion of the first polarity, to the common electrode contact pixels having the contact point 220 where the common electrode is contacted with the gate electrode. In addition, the data driving part 140 equally applies the data signal having the first polarity and the data signal having the second polarity to the pixels 120 including the first pixel 211, the second pixel 212, the third pixel 213 and the fourth pixel 214.

For example, the data driving part 140 repeatedly applies data signals having the first polarity, the second polarity, the first polarity, the second polarity, the second polarity, the first polarity, the second polarity and the first polarity to the pixels disposed in the second direction D2, in the stated order. In addition, the data driving part 140 repeatedly applies data signals having the first polarity, the second polarity, the second polarity, the first polarity, the first polarity, the second polarity, the second polarity, the first polarity, the second polarity, the first polarity, the first polarity, the second polarity, the second polarity, the first polarity, the first polarity and the second polarity to the pixels disposed in the first direction D1, in the stated order.

Thus, data voltages having the first polarity, the second polarity, the first polarity, the second polarity, the second polarity, the first polarity, the second polarity and the first polarity are repeatedly charged in the pixels disposed in the second direction D2, in the stated order, and data voltages having the first polarity, the second polarity, the second polarity, the first polarity, the first polarity, the second polarity, the second polarity, the first polarity, the second polarity, the first polarity, the first polarity, the second polarity, the second polarity, the first polarity, the first polarity and the second polarity are repeatedly charged in the pixels disposed in the first direction D1, in the stated order.

Thus, the number of the common electrode contact pixels in which the data voltage having the first polarity is charged and the number of the common electrode contact pixels in which the data voltage having the second polarity is charged are the same. In addition, the number of the pixels in which the data voltage having the first polarity is charged and the number of the pixels in which the data voltage having the second polarity is charged are the same.

The first polarity may be the positive polarity, and the second polarity may be the negative polarity. Alternatively, the first polarity may be the negative polarity, and the second polarity may be the positive polarity. Here, the positive polarity and the negative polarity may be determined with respect to the reference voltage. Thus, the data voltage having the positive polarity may be greater than the reference voltage, and the data voltage having the negative polarity may be less than the reference voltage. For example, the reference voltage may be the common voltage.

Figure 6A:
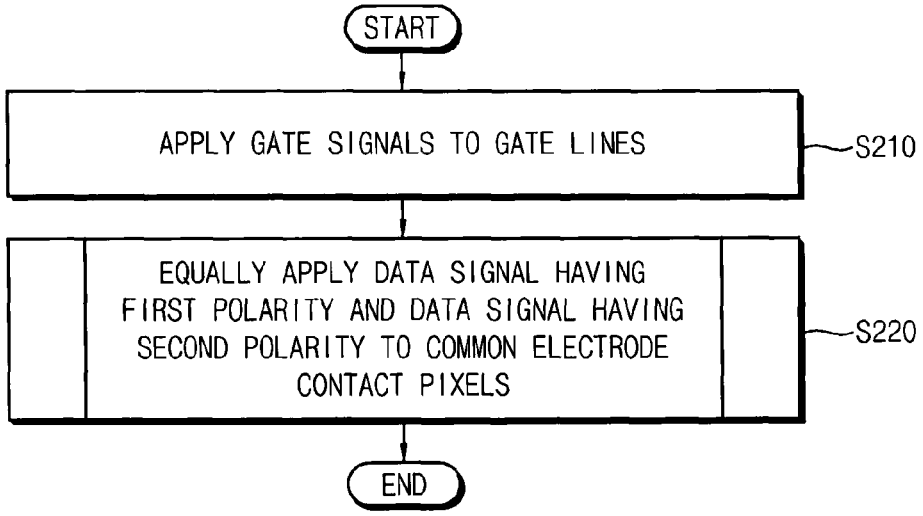
FIGS. 6A and 6B are flow charts illustrating a method of driving a display panel performed by the display panel driving apparatus of FIG. 1, according to the present exemplary embodiment.
Figure 6B:
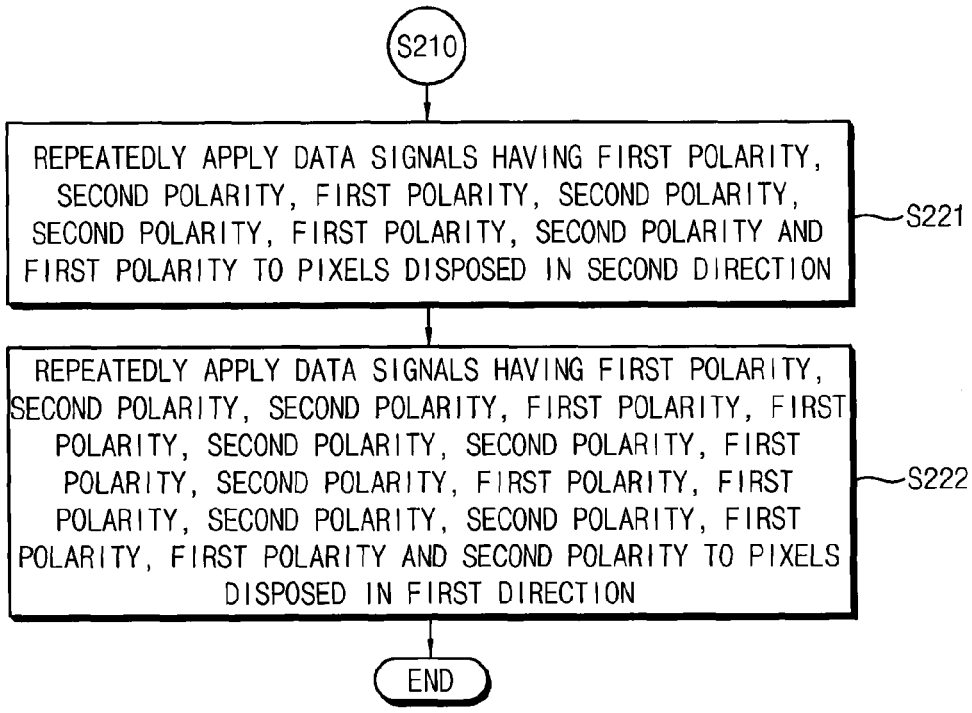

FIGS. 6A and 6B are flow charts illustrating a method of driving a display panel performed by the display panel driving apparatus of FIG. 1, according to exemplary embodiments of the present inventive concept.

Referring to FIGS. 1 and 5 to 6B, the gate signals GS are applied to the gate lines DL (step S210). For example, the gate driving part 130 generates the gate signal GS in response to the gate start signal STV and the gate clock signal CLK1 provided from the timing controlling part 150, and outputs the gate signal GS to the gate line GL.

The data signal having the first polarity and the data signal having the second polarity are equally applied to the common electrode contact pixels (step S220). For example, the data driving part 140 repeatedly applies the data signals having the first polarity, the second polarity, the first polarity, the second polarity, the second polarity, the first polarity, the second polarity and the first polarity to the pixels disposed in the second direction D2, in the stated order (step S221). In addition, the data driving part 140 repeatedly applies the data signals having the first polarity, the second polarity, the second polarity, the first polarity, the first polarity, the second polarity, the second polarity, the first polarity, the second polarity, the first polarity, the first polarity, the second polarity, the second polarity, the first polarity, the first polarity and the second polarity to the pixels disposed in the first direction D1, in the stated order (step S222).

Thus, the data voltages having the first polarity, the second polarity, the first polarity, the second polarity, the second polarity, the first polarity, the second polarity and the first polarity are repeatedly charged in the pixels disposed in the second direction D2, in the stated order, and data voltages having the first polarity, the second polarity, the second polarity, the first polarity, the first polarity, the second polarity, the second polarity, the first polarity, the second polarity, the first polarity, the first polarity, the second polarity, the second polarity, the first polarity, the first polarity and the second polarity are repeatedly charged in the pixels disposed in the first direction D1, in the stated order.

In the method of driving the display panel shown in FIG. 6A, the step S210 and the step S220 are sequentially performed, but the method is not limited to this particular sequence. For example, the step S210 and the step S220 may be simultaneously performed. In addition, in the method of driving the display panel shown in FIG. 6B, the step S221 and the step S222 are sequentially performed, but the method is not limited to this particular sequence. For example, the step S221 and the step S222 may be simultaneously performed.

According to an exemplary embodiment of the present invention, the data voltage having the first polarity and the data voltage having the second polarity are equally charged in the common electrode contact pixels. Therefore, a flicker of an image displayed on the display panel 110 may be decreased, and thus display quality of the display apparatus 100 may be increased.

According to the method of driving a display panel, the display panel driving apparatus for performing the method and the display apparatus having the display panel driving apparatus, a flicker of an image displayed on a display panel may be decreased, and thus display quality of a display apparatus may be increased.

The foregoing is illustrative of the present inventive concept and is not to be construed as limiting thereof.

Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept.

What is claimed is:

1. A method of driving a display panel, the method comprising:

applying gate signals to a plurality of gate lines extending in a first direction, wherein the display panel comprises the plurality of gate lines, a plurality of data lines extending in a second direction perpendicular to the first direction, and a plurality of pixels defined by the plurality of gate lines and the plurality of data lines, the plurality of pixels comprising common electrode contact pixels in which a common electrode is in contact with a gate electrode that extends from the plurality of gate lines; and applying data signals having a first polarity and data signals having a second polarity, inverse to the first polarity, to the common electrode contact pixels, wherein the data signals having the first polarity are applied to a same number of the common electrode contact pixels as the data signals having the second polarity are applied to, and wherein the applying of the data signals of the first and second polarities comprises repeatedly applying the data signals to the pixels, of the plurality of pixels, disposed in the second direction in the following order: the data signals having the first polarity, the data signals having the second polarity, the data signals having the first polarity, the data signals having the first polarity, the data signals having the second polarity, the data signals having the first polarity, the data signals having the second polarity, and the data signals having the second polarity.

2. The method of claim 1, wherein the applying of the data signals of the first and second polarities further comprises repeatedly applying the data signals to the pixels, of the plurality of pixels, disposed in the first direction in the following order: the data signals having the first polarity, the data signals having the second polarity, the data signals having the second polarity, the data signals having the first polarity, the data signals having the first polarity, the data signals having the second polarity, the data signals having the second polarity, the data signals having the first polarity, the data signals having the second polarity, the data signals having the first polarity, the data signals having the first polarity, the data signals having the second polarity, the data signals having the second polarity, the data signals having the first polarity, the data signals having the first polarity, and the data signals having the second polarity.

3. The method of claim 1, wherein the applying the data signals comprises equally applying the data signal having the first polarity and the data signal having the second polarity to the pixels.

4. The method of claim 1, wherein the plurality of pixels includes a red pixel, a green pixel, a blue pixel and a white pixel.

5. The method of claim 4, wherein the blue pixel corresponds to the common electrode contact pixel.

6. The method of claim 5, wherein the display panel sequentially and repeatedly includes the red pixel, the green pixel, the blue pixel and the white pixel in the first direction in an odd-numbered pixel row.

7. The method of claim 6, wherein the display panel sequentially and repeatedly includes the blue pixel, the white pixel, the red pixel and the green pixel in the first direction in an even-numbered pixel row.

8. The method of claim 7, wherein the blue pixels alternately include the common electrode contact pixel in the first direction.

9. The method of claim 7, wherein the blue pixels alternately include the common electrode contact pixel in the second direction.

10. A method of driving a display panel, the method comprising:

applying gate signals to a plurality of gate lines extending in a first direction, wherein the display panel comprises the plurality of gate lines, a plurality of data lines extending in a second direction perpendicular to the first direction, and a plurality of pixels defined by the plurality of gate lines and the plurality of data lines, the plurality of pixels comprising common electrode contact pixels in which a common electrode is in contact with a gate electrode that extends from the plurality of gate lines; and applying data signals having a first polarity and data signals having a second polarity, inverse to the first polarity, to the common electrode contact pixels, wherein the data signals having the first polarity are applied to a same number of the common electrode contact pixels as the data signals having the second polarity are applied to, and wherein the applying of the data signals of the first and second polarities comprises repeatedly applying the data signals to the pixels, of the plurality of pixels, disposed in the second direction in the following order: the data signals having the first polarity, the data signals having the second polarity, the data signals having the first polarity, the data signals having the second polarity, the data signals having the second polarity, the data signals having the first polarity, the data signals having the second polarity, and the data signals having the first polarity.

11. The method of claim 10, wherein the applying of the data signals of the first and second polarities further comprises repeatedly applying the data signals to the pixels, of the plurality of pixels, disposed in the first direction in the following order: the data signals having the first polarity, the data signals having the second polarity, the data signals having the second polarity, the data signals having the first polarity, the data signals having the first polarity, the data signals having the second polarity, the data signals having the second polarity, the data signals having the first polarity, the data signals having the second polarity, the data signals having the first polarity, the data signals having the first polarity, the data signals having the second polarity, the data signals having the second polarity, the data signals having the first polarity, the data signals having the first polarity, and the data signals having the second polarity.

12. A display panel driving apparatus comprising:

a gate driving part configured to apply a plurality of gate signals to a plurality of gate lines, extending in a first direction, of a display panel, the display panel including the plurality of gate lines, a plurality of data lines extending in a second direction, perpendicular to the first direction, and a plurality of pixels defined by an intersection of the plurality of gate lines and the plurality of data lines, and the plurality of pixels having common electrode contact pixels in which a common electrode is in contact with a gate electrode extending from the plurality of gate lines; and a data driving part configured to apply data signals having a first polarity and data signals having a second polarity to the common electrode contact pixels, the second polarity being inverse to the first polarity, wherein the data signals having the first polarity are applied to a same number of the common electrode contact pixels as the data signals having the second polarity are applied to, and wherein the data driving part repeatedly applies the data signals to the pixels, of the plurality of pixels, disposed in the second direction in the following order: the data signals having the first polarity, the data signals having the second polarity, the data signals having the first polarity, the data signals having the first polarity, the data signals having the second polarity, the data signals having the first polarity, the data signals having the second polarity, and the data signals having the second polarity, and repeatedly applies the data signals to the pixels, of the plurality of pixels, disposed in the first direction in the following order: the data signals having the first polarity, the data signals having the second polarity, the data signals having the second polarity, the data signals having the first polarity, the data signals having the first polarity, the data signals having the second polarity, the data signals having the second polarity, the data signals having the first polarity, the data signals having the second polarity, the data signals having the first polarity, the data signals having the first polarity, the data signals having the second polarity, the data signals having the second polarity, the data signals having the first polarity, the data signals having the first polarity, and the data signals having the second polarity.

13. The display panel driving apparatus of claim 12, wherein the plurality of pixels include a red pixel, a green pixel, a blue pixel and a white pixel, and corresponds to the common electrode contact pixel.

14. A display panel driving apparatus comprising:

a gate driving part configured to apply a plurality of gate signals to a plurality of gate lines, extending in a first direction, of a display panel, the display panel including the plurality of gate lines, a plurality of data lines extending in a second direction, perpendicular to the first direction, and a plurality of pixels defined by an intersection of the plurality of gate lines and the plurality of data lines, and the plurality of pixels having common electrode contact pixels in which a common electrode is in contact with a gate electrode extending from the plurality of gate lines; and a data driving part configured to apply data signals having a first polarity and data signals having a second polarity to the common electrode contact pixels, the second polarity being inverse to the first polarity, wherein the data signals having the first polarity are applied to a same number of the common electrode contact pixels as the data signals having the second polarity are applied to, and wherein the data driving part repeatedly applies the data signals to the pixels, of the plurality of pixels, disposed in the second direction in the following order: the data signals having the first polarity, the data signals having the second polarity, the data signals having the first polarity, the data signals having the second polarity, the data signals having the second polarity, the data signals having the first polarity, the data signals having the second polarity, the data signals having the first polarity, the data signals having the second polarity, the data signals having the first polarity, the data signals having the first polarity, the data signals having the second polarity, the data signals having the second polarity, the data signals having the first polarity, the data signals having the first polarity, and the data signals having the second polarity, and repeatedly applies the data signals to the pixels, of the plurality of pixels, disposed in the first direction in the following order: the data signals having the first polarity, the data signals having the second polarity, the data signals having the second polarity, the data signals having the first polarity, the data signals having the first polarity, the data signals having the second polarity, the data signals having the second polarity, the data signals having the first polarity, the data signals having the second polarity, the data signals having the first polarity, the data signals having the first polarity, the data signals having the second polarity, the data signals having the second polarity, the data signals having the first polarity, the data signals having the first polarity, and the data signals having the second polarity.

15. A display apparatus comprising:

a display panel comprising a plurality of gate lines extending in a first direction, a plurality of data lines extending in a second direction perpendicular to the first direction, and a plurality of pixels defined by an intersection between the plurality of gate lines and the plurality of data lines, and the plurality of pixels having common electrode contact pixels in which a common electrode thereof is in contact with a gate electrode extending from the plurality of gate lines; and a display panel driving apparatus comprising a gate driving part configured to apply gate signals to the plurality of gate lines, and a data driving part configured to apply a data signal having a first polarity and a data signal having a second polarity to the common electrode contact pixels, the second polarity being an inversion of the first polarity, wherein the data signals having the first polarity are applied to a same number of the common electrode contact pixels as the data signals having the second polarity are applied to, and wherein the data driving part repeatedly applies the data signals to the pixels, of the plurality of pixels, disposed in the second direction in the following order: the data signals having the first polarity, the data signals having the second polarity, the data signals having the first polarity, the data signals having the first polarity, the data signals having the second polarity, the data signals having the first polarity, the data signals having the second polarity, and the data signals having the second polarity, and repeatedly applies the data signals to the pixels, of the plurality of pixels, disposed in the first direction in the following order: the data signals having the first polarity, the data signals having the second polarity, the data signals having the second polarity, the data signals having the first polarity, the data signals having the first polarity, the data signals having the second polarity, the data signals having the second polarity, the data signals having the first polarity, the data signals having the second polarity, the data signals having the first polarity, the data signals having the first polarity, the data signals having the second polarity, the data signals having the second polarity, the data signals having the first polarity, the data signals having the first polarity, and the data signals having the second polarity.

16. The display apparatus of claim 15, wherein the plurality of pixels includes a red pixel, a green pixel, a blue pixel and a white pixel, and the blue pixel corresponds to the common electrode contact pixel.

17. The display apparatus of claim 16, wherein the display panel sequentially and repeatedly includes the red pixel, the green pixel, the blue pixel and the white pixel in the first direction in an odd-numbered pixel row, and sequentially and repeatedly includes the blue pixel, the white pixel, the red pixel and the green pixel in the first direction in an even-numbered pixel row.

18. The display apparatus of claim 17, wherein the blue pixels alternately include the common electrode contact pixel in the first direction and the second direction.

* * * * *